United States Patent [19]

Leask

[11] 3,988,589

[45] Oct. 26, 1976

[54] METHODS OF COLLIMATOR FABRICATION

[75] Inventor: John W. Leask, Carlisle, Mass.

[73] Assignee: Engineering Dynamics Corporation, Westford, Mass.

[22] Filed: July 28, 1975

[21] Appl. No.: 599,599

[52] U.S. Cl. ..... 250/505

[51] Int. Cl.[2] ..... G21F 5/02

[58] Field of Search ..... 250/505, 514

[56] References Cited

UNITED STATES PATENTS

| | | | |
|---|---|---|---|
| 2,731,713 | 1/1956 | Schaefer | 250/505 |
| 3,921,000 | 11/1975 | Muehllehner | 250/505 |

*Primary Examiner*—Craig E. Church

*Attorney, Agent, or Firm*—Russell & Nields

[57] ABSTRACT

A collimator for radiation receiving and imaging devices and a method for making such collimators including the steps of casting a plurality of modular elements each having a base from one side of which extends a first plurality of spaced columns and from the opposite side of which extends a second plurality of columns of shorter height than the first directly opposite the spaces between the first plurality of columns, inserting the first plurality of columns of one module into the spaces between the second pluraity of columns of the succeeding module in a modified mortis-tenon relationship successively and affixing them in that position, placing the assembled grid into a frame, and filling the spaces between the grid and the frame with radiation-opaque material, thereby forming an integral functional collimating unit.

14 Claims, 5 Drawing Figures

METHODS OF COLLIMATOR FABRICATION

BACKGROUND OF INVENTION

1. Field of Invention

This invention relates in general to grid-like structures of the type suitable for use as collimators for shielding radiation receiving and imaging devices from the effects of distorting radiation, and more particularly to structures of the above type suitable for use with high energy, i.e. 100 to 1,000 KEV, radiation.

2. Summary of Prior Art

The use of such structures as collimators is well known as may for example be seen from the Anger camera case. This device is a special type of radiation receiver used by the medical profession to locate and judge the extent of diseased tissue within a patient's body by the creation of photograph-like images of radioactive concentrations therein. A radioactive material is injected into the patient's bloodstream or administered orally which tends to collect in the diseased tissue. Formation of an image of an object which is a radioactive source and which therefor is its own source of radiation, however, presents a situation nonanalogous to formation of an image of an object which is illuminated by common light, or even X-rays, from a separate source, as in conventional photography. In order to get a clear image of a radioactive concentration a selection must be made from the rays emanating from the concentration in all directions of those rays which will clearly produce the image. This selection may be made so as to produce an enlarged, a miniaturized, or a same-size image of the concentration, but in all cases nonselected rays must be kept from the receiver. A collimator of a radiation absorbing material such as lead has been found to perform the selection function well and is presently used with all such devices for this purpose.

The Anger camera has thus become a significant medical tool both for diagnostic purposes and as a means to facilitate surgery by decreasing exploratory time because the spatial location of the diseased area is precisely known and by assuring all diseased tissue is found because the precise extent of the diseased area is also known.

Presently the above-described units are used with radiation energy levels of about 150 KEV, and many types of collimators have been produced for this energy level which are operationally effective and relatively efficiently manufacturable. An example of one such collimator is a number of corrugated sheets of lead approximately 0.010 inch thick having flattened ridges, sealed together by epoxy cement in a ridge-to-ridge configuration. Units of this type are particularly useful in examinations using a scintillation camera. However, I have found that new medical techniques have created a demand for a collimator suitable for use at energy levels approaching 300 KEV, and above.

It is elementary that as the radiation energy level increases, the thickness of the collimator walls must also increase. Experience indicates, however, that the efficient fabrication of a collimator suitable for use with such high energy radiation is by no means elementary. Various methods have been tried, but for one reason or another each was unsatisfactory.

For example, casting the collimator as a single unit using removable pins in the mold to provide the holes has been tried. This method while producing an operational device is impractical since due to high friction between the cast lead and the pins and the fact that some collimators are convergent or divergent (to allow enlarged or miniaturized image formation) relative to the radiation source each of the pins used to create the holes must be removed individually. This process is time consuming and costly, especially when one realizes that some such collimators have 1000 or more such holes.

A second exemplary attempt was to cast thick corrugated lead sheets and assemble them as was done at low energy. This alternative also failed due in this case to joint leakage i.e. the epoxied joints are permeable to high energy radiation and since these joints are adjacent to each other in a straight line in this case too much distoring radiation reaches the receiver. Further, attempts to avoid this problem in this alternative by creating an overlap raised insurmountable technical assembly problems.

SUMMARY OF THE INVENTION

The present invention solves the above problem by taking advantage of the subtle fact that joint leakage is only a problem with respect to rays which are substantially non-parallel with the holes. Stated in slightly different terms, this means that the penetration of rays substantially parallel to those passing through the holes through the joints do not effect the image enough to cause concern. Thus, it was found that the successful operational characteristics of the single unit casting may be successfully approximated using modules adapted to fit together to form a grid-like pattern with a series of mortis-tenon type joints and that successful units are thereby possible at essentially all energy levels, the only limiting factor being the sophistication of the module fabrication method used. The details of one preferred embodiment are set forth below.

It is thus an object of the present invention to provide a collimator suitable for use with essentially all energy levels of radiation which is modular in construction thereby avoiding the problems of single unit casting, yet which is easy to fabricate and assemble, and which has no passable path for distoring rays.

It is also an object of the present invention to provide a method of collimator manufacture which is efficient at production rates.

Further, it is an object of the present invention to provide a collimator which may be easily adapted to fit within any desired overall shape and which may be given any optimum hole shape chosen.

BRIEF DESCRIPTION OF THE DRAWINGS

These, as well as other features, objects, and advantages of the present invention, will be more clearly understood by reference to the following detailed description of the preferred embodiment of the present invention and to the drawings in which.

DESCRIPTION OF PREFERRED EMBODIMENTS

Figure 1:
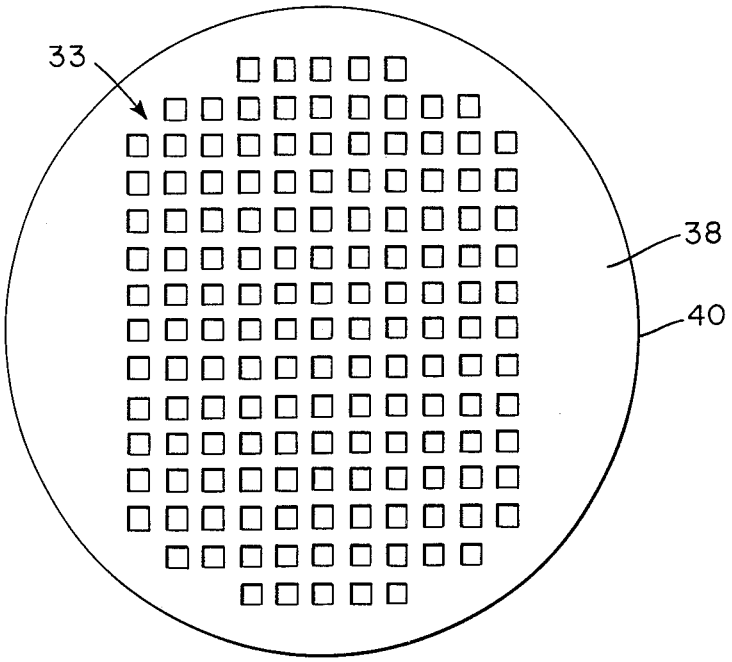
FIG. 1 is a plan view of an assembled collimator in accord with the present invention suitable for use with an Anger camera.

In providing a collimator as shown in FIG. 1 suitable for use with high energy radiation as previously defined the present invention specifically recognizes that a collimator cast as a unit in the configuration of FIG. 1 is the best known high energy collimator from an operational standpoint. It is also known from low energy work that modularization presents great economies in the efficiency and flexibility of production it allows. The present invention thus combines these divergent concepts in such a way as to optimize both operational and production efficiency.

Figure 2:
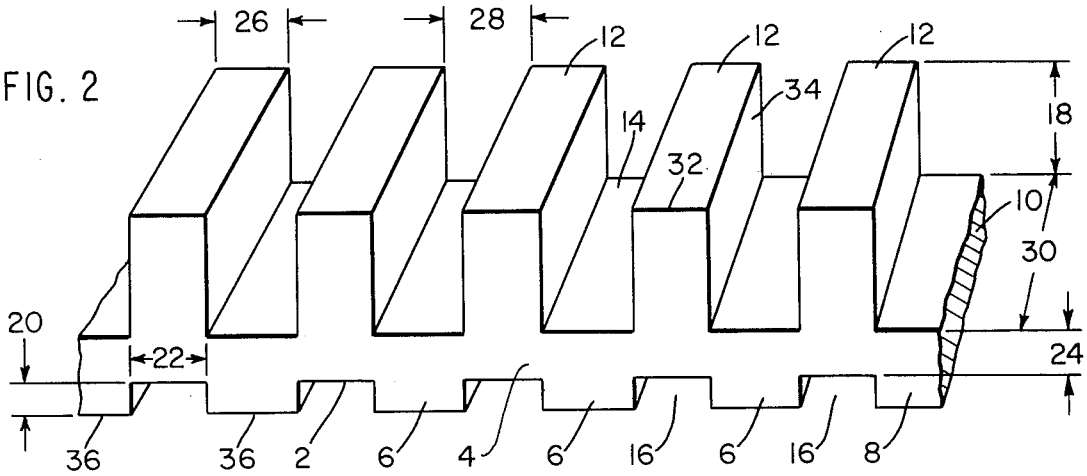
FIG. 2 is an enlarged perspective view of a portion of a cast collimator module in accord with the present invention.

FIG. 2 shows a preferred embodiment of a cast module for the above purpose. As used herein the term "cast" is specifically contemplated to include die casting, permanent mold casting, powdered metal techniques, extruding, lead filled epoxies, and other similar fabrication methods. From the lower side 2 of the base portion 4 of this module is first plurality of columns indicated at 6 project at spaced intervals parallel to each other. Each of these columns is of substantially rectangular cross section and extends from the top 8 to the bottom 10 of base portion 4. Similarly, a second plurality of columns indicated at 12 project from the upper side 14 of the base portion 4 of this modular in the area directly opposite the channels 16 formed by the columns 6. The columns 12 are also parallel to each other, extend from the top 8 to the bottom 10 of base portion 10, and are of substantially rectangular cross-section. (Note: In the preferred case, columns 12 taper somewhat along their height dimension 18.) The following chart indicates what I have found to be the preferred dimensions for such a module for two given radiation ranges.

| DIMENSION | DESCRIPTION | 225-300 KEV MEASUREMENT | 150-225 KEV MEASUREMENT |
|---|---|---|---|
| 22 | Thickness of Base of Column, Width of Channel | .100 ± .005 | .083 ± .003 |
| 24 | Thickness of Base | .060 ± .003 | .050 ± .001 |
| 26 | Width at Top of Column | .095 + .000 − .003 | .080 + .000 − .003 |
| 28 | Width Between Columns | .123 ± .010 | .133 ± .010 |
| 18 | Height of Columns 12 | .163 ± .002 | .163 ± .002 |
| 20 | Height of Columns 6 | .040 ± .002 | .030 ± .002 |
| 30 | Width of Base | 2.97 ± .015 | 1.97 ± .015 |

Figure 3:
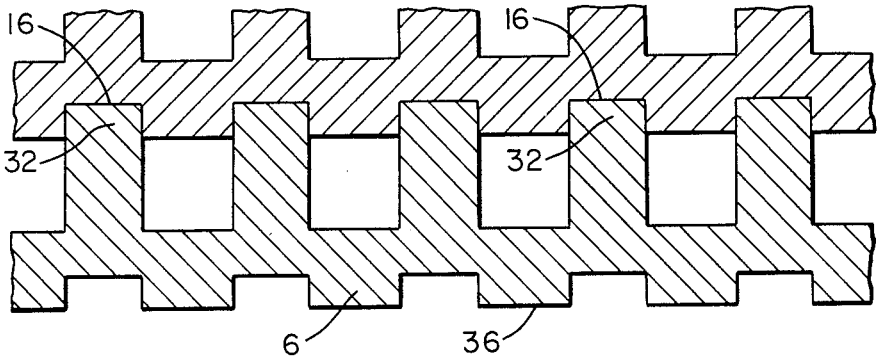
FIG. 3 is an enlarged cross sectional view of two modules in accord with the present invention in assembled configuration.

Given the above described modules then, the present invention contemplates that the outer edge 32 of the columns 12 of one module be inserted in and affixed within the channels 16 of a second module, as shown in FIG. 3 in a series of modified form mortis-tenon joints, and so on until the collimator grid structure generally indicated at 33 desired is complete. The affixation mentioned above is contemplated to be simple pressfitting, but also may be cemented especially in the case where the tolerances set for the slight taper of the columns 12 are too large to assure consistantly tight pressfitting.

Figure 4:
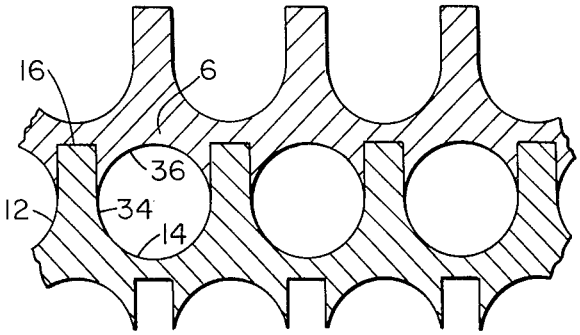
FIG. 4 is a cross-sectional view of a portion of two modules in accord with the present invention in assembled relation defining round holes.
Figure 5:
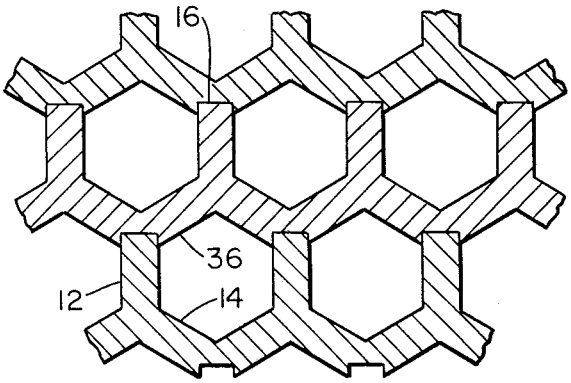
FIG. 5 is a cross-sectional view of a portion of two modules in accord with the present invention in assembled relation defining hexagonal holes.

FIGS. 4 and 5 indicate two alternative hole shapes of the many which a person skilled in the art might desire. The important point is that the mortis-tenon relationship between the columns 12 and channels 16 must be maintained. Otherwise one is limited only by the practical feasibility of casting the desired indentations into the sides 34 of the columns 12, the portions of the upper side 14 of the base 4 between the columns 12, and the upper face 36 of the columns 6.

The collimator assembly is then completed by locking the assembled grid structure 33 into a frame representatively shown at 40 and filling the open areas 38 between the grid 33 and the frame 40 with lead or some other shielding material.

It should be understood that the embodiments and practices described and portrayed herein have been presented by way of disclosure, rather than limitation, and that various subtitutions, modifications, and combinations may be effected without departure from the spirit and scope of this invention in its broader aspects. For example, the columns of each module need not necessarily be parallel to each other nor need they define channels which are perpendicularly orientated with respect to the top 8 and the bottom 10. Also, the use of such collimators is specifically contemplated to extend beyond the above recited Anger camera example to scanners and other radiation receiving equipment, and in some contexts to radiation producers as well.

I claim:

1. A method for producing a collimator suitable for forming an image upon a radiation sensitive member of a radiation receiver of a radioactive object, which method comprises the steps of:

casting a plurality of modular elements of material opaque to radiation from said radioactive object, each said modular element comprising a substantially flat base having a plurality of elongated ridges on one side thereof so as to form elongated channels therebetween, the opposite side thereof having grooves adapted to receive corresponding ridges of a neighboring module in a modified mortis-tenon relationship, and inserting and affixing the ridges of each module into the grooves of its neighbor.

2. The method for producing a collimator of claim 1, wherein each said modular element has a base having two ends, two sides, a top and a bottom; a first plurality of columns, each having a top, a bottom an inner side, an outer side, two ends, and a substantially rectangular cross section, projecting from one side of said base at spaced intervals parallel to each other and extending from the top of said base to the bottom thereof; and a second plurality of columns, each having an inner side of width equal to the spacing between the columns of said first plurality of columns, an outer side of width substantially the same but in no case greater than said spacing, and an inner side-outer side dimension greater than the inner side-outer side dimension of the of the columns of said first plurality thereof, projecting from the other side of said base in the areas directly opposite the spacings between the columns of said first plurality thereof parallel to each other and extending from the top of said base to the bottom thereof;

the columns of said second plurality thereof of each modular element are inserted into the channels formed by said first plurality of columns of a succeeding modular element such that the outer sides of said second plurality of columns of each modular element are affixed in substantially touching relation with that portion of the base of the succeeding modular element which forms a portion of the channels defined by said first plurality of columns of the succeeding modular element; and having the additional steps of securing the resulting configuration into a mounting frame such that all areas between the assembled modular configuration and said frame are impenetrable by radiation.

3. The method of claim 1 wherein the material opaque to radiation from said radioactive object is selected from the group consisting of lead, tungsten, tantalum, depleted uranium, and aluminum.

4. The method of claim 1 wherein said radiation receiver is an Anger camera.

5. The method of claim 2 wherein a layer of adhesive is used to affix the columns of said second plurality thereof of each modular element to the channels formed by said first plurality of columns of a succeeding modular element.

6. The method of claim 2 wherein a press fitting relationship is used to affix the columns of said second plurality thereof of each modular element to the channels formed by said first plurality of columns of a succeeding modular element.

7. The method of claim 2 wherein said first plurality of columns is cast convergent relative to the top of said base and wherein said second plurality of columns is cast convergent relative to the top of said base.

8. The method of claim 2 wherein said first plurality of columns is cast divergent relative to the top of said base and wherein said second plurality of columns is cast divergent relative to the top of said base.

9. A collimator for use in forming an image upon a radiation sensitive member of a radiation receiver of a radioactive object, said collimator comprising a plurality of modular cast elements of material opaque to radiation from said radioactive object, each said modular element comprising a substantially flat base having a plurality of elongated ridges on one side thereof so as to form elongated channels therebetween, the opposite side thereof having grooves adopted to receive corresponding ridges of a neighboring modular element in a modified mortis-tenon relationship.

10. The collimator of claim 9 wherein, each modular element has a base having two sides, two ends, a top and a bottom;

a first plurality of columns, each having a top, a bottom, an inner side, an outer side, two ends, and a substantially rectangular cross section, projecting from one side of said base at spaced intervals parallel to each other and extending from the top of said base to the bottom thereof; and a second plurality of columns, each having an inner side of width equal to the spacing between the columns of said first plurality of columns, an outer side of width substantially the same but in no case greater than said spacing, and an inner side-outer side dimension greater than the inner side-outer dimension of the columns of said first plurality thereof, projecting from the other side of said base in the areas directly opposite spacings between the columns of the first plurality thereof, parallel to each other and extending from the top of said base to the bottom thereof;

wherein the columns of said second plurality thereof of each modular element are inserted into and affixed within the channels formed by the columns of said first plurality thereof of the next succeeding modular element and wherein the assembled modular elements are locked into a frame-like element adapted for mounting on said radiation receiver.

11. The collimator of claim 10 wherein the material opaque to radiation from said radioactive object is selected for the group consisting of lead, tungsten, tantalum, depleted uranium, and aluminum.

12. The collimator of claim 9 wherein the radiation receiver is an Anger camera, or similar device.

13. The collimator of claim 10 wherein the columns of each plurality thereof are convergent relative to the top of said base.

14. The collimator of claim 10 wherein the columns of each plurality thereof are divergent relative to the top of said base.

* * * * *